US008210248B2

(12) United States Patent
Vogel

(10) Patent No.: US 8,210,248 B2
(45) Date of Patent: Jul. 3, 2012

(54) METHOD AND SYSTEMS FOR COMPACT, MICRO-CHANNEL, LAMINAR HEAT EXCHANGING

(75) Inventor: Herman Vogel, Sandy Hook, CT (US)

(73) Assignee: ASML Holding N.V., Veldhoven (NL)

( * ) Notice: Subject to any disclaimer, the term of this patent is extended or adjusted under 35 U.S.C. 154(b) by 930 days.

(21) Appl. No.: 11/812,634

(22) Filed: Jun. 20, 2007

(65) Prior Publication Data

US 2008/0035319 A1 Feb. 14, 2008

Related U.S. Application Data

(63) Continuation of application No. 10/902,873, filed on Aug. 2, 2004, now Pat. No. 7,234,514.

(51) Int. Cl.
*F28F 3/12* (2006.01)

(52) U.S. Cl. ..... 165/170; 165/80.4

(58) Field of Classification Search ..... 165/80.4, 165/80.5, 170
See application file for complete search history.

(56) References Cited

U.S. PATENT DOCUMENTS

| | | | | |
|---|---|---|---|---|
| 4,516,632 | A | 5/1985 | Swift et al. | |
| 5,311,360 | A | 5/1994 | Bloom et al. | |
| 6,400,012 | B1 * | 6/2002 | Miller et al. | 257/712 |
| 6,415,860 | B1 * | 7/2002 | Kelly et al. | 165/148 |
| 6,634,421 | B2 | 10/2003 | Ognibene et al. | |
| 6,865,081 | B2 | 3/2005 | Meyer et al. | |
| 6,887,450 | B2 | 5/2005 | Chen et al. | |
| 6,892,802 | B2 | 5/2005 | Kelly et al. | |
| 7,234,514 | B2 | 6/2007 | Vogel | |
| 2003/0234465 | A1 * | 12/2003 | Chen et al. | 264/108 |
| 2004/0104010 | A1 * | 6/2004 | Kenny et al. | 165/80.4 |
| 2004/0188066 | A1 | 9/2004 | Upadhya et al. | |
| 2005/0205241 | A1 | 9/2005 | Goodson et al. | |

FOREIGN PATENT DOCUMENTS

| | | |
|---|---|---|
| JP | 6-5755 | 1/1994 |
| JP | 2002-5591 A | 1/2002 |
| WO | WO 01/69158 A1 | 9/2001 |
| WO | WO 2004/042305 A2 | 5/2004 |

OTHER PUBLICATIONS

English Translation of the Notification of Reason(s) for Refusal, from Japanese Patent Appl. No. 2005-224568, 4 pages, dispatched Dec. 11, 2007. English abstract of Japanese Patent Publication No. JP 6-5755, 1 page.
English abstract of Japanese Patent Publication No. JP 2002-5591 A, 1 page.
English abstract of Japanese Patent Publication No. JP 2003-527751, 1 page.
Tuckerman, D.B. and Pease, R.F.W., "High-Performance Heat Sinking for VLSI," IEEE Electron Device Letters, vol. EDL-2, No. 5, May 1981, pp. 126-129.

* cited by examiner

*Primary Examiner* — Teresa Walberg
(74) *Attorney, Agent, or Firm* — Sterne, Kessler, Goldstein & Fox P.L.L.C

(57) ABSTRACT

A heat exchanging core for a micro-channel heat exchanger includes at least one heat conducting plate, which has at least one channel formed between a first side and a second side of the heat conducting plate. The at least one channel has a channel length to hydraulic diameter ratio of less than 100, wherein the channel length is defined as a distance between the first and second sides of the heat conducting plate. A micro-channel heat exchanger includes a housing defining a cavity therein, the housing including an inlet and an outlet coupled to the cavity, and a heat exchanging core positioned within the cavity between the liquid inlet and the liquid outlet. The present invention provides, among other features, improved heat transfer, reduced pressure drops, and reduced jitter. The present invention can be implemented for laminar flow and/or turbulent flow environments.

30 Claims, 18 Drawing Sheets

METHOD AND SYSTEMS FOR COMPACT, MICRO-CHANNEL, LAMINAR HEAT EXCHANGING

CROSS-REFERENCE TO RELATED APPLICATIONS

This application is a continuation of U.S. patent application Ser. No. 10/902,873, filed Aug. 2, 2004, (that issued as U.S. Pat. No. 7,234,514 on Jun. 26, 2007), which is incorporated by reference herein in its entirety.

BACKGROUND OF THE INVENTION

1. Field of the Invention

The invention relates to heat exchanging and, more particularly, to methods and systems for compact, micro-channel, laminar heat exchanging.

2. Related Art

Passive cooling techniques, such as free and forced air convection and radiative cooling, have been around for decades. For many applications, however, passive cooling techniques are insufficient. For example, spatial light modulator ("SLM") chips generate heat loads that are too large for passive cooling.

SLMs are variable contrast devices used in televisions and lithography tools, for example, to selectively impart a pattern on an imaging light source. Conventional SLMs, such as digital mirror devices, typically include over one million miniature mirrors in under a square inch footprint.

Many applications, including SLMs, utilize active cooling techniques using fluids, such as water. In fact, we are on the threshold of a "nano technology" era where active liquid cooling of a variety of types of electronics may replace the conventional use of free and forced air convection and radiative cooling.

Conventional liquid cooling techniques, however, are too large and cumbersome for many applications. Conventional liquid cooling techniques also tend to cause jitter problems that can adversely affect components such as optical elements in SLMs.

What are needed therefore are reduced-size active cooling methods and systems. What are also needed are reduced-size active cooling methods and systems having improved laminar flow to reduce or eliminate jitter.

SUMMARY OF THE INVENTION

The present invention is directed to reduced-size active cooling methods and systems, and reduced-size active cooling methods and systems having improved laminar flow to reduce or eliminate jitter.

According to an embodiment of the invention, a heat exchanging core for a micro-channel heat exchanger includes at least one heat conducting plate, which has at least one channel formed between a first side and a second side of the heat conducting plate. The at least one channel has a channel length to hydraulic diameter ratio of less than 100, wherein the channel length is defined as a distance between the first and second sides of the heat conducting plate.

According to an embodiment of the invention, a method of transferring heat from an object includes positioning a heat exchanger body proximate to the object and providing a coolant liquid into a cavity within the heat exchanger body. The method further includes passing the coolant liquid, from a fluid inlet of the cavity to a fluid outlet of the cavity, through a plurality of channels formed through a plurality of plates within the cavity of the heat exchanger body, the channels being independent of the fluid inlet and the fluid outlet and having an average channel length to hydraulic diameter ratio of less than 100, wherein the plates are in thermal contact with the body. The method further includes transferring heat from the plates to the coolant liquid as the coolant liquid passes through the channels and refreshing the coolant liquid. In an embodiment, the providing, passing, transferring, and refreshing steps can be repeated.

According to an embodiment of the invention, a method of making a heat exchanger includes providing a housing having a cavity, the housing including a fluid inlet and a fluid outlet coupled to the cavity. The method further includes providing a heat exchanging core having at least one heat conducting plate with channels formed therethrough, the channels having an average channel length to hydraulic diameter ratio of less than 100. The method further includes positioning the heat exchanging core within the cavity between the fluid inlet and the fluid outlet. In an embodiment, the channels are independent of the fluid inlet and the fluid outlet and provide a fluid path within the cavity for fluid running between the fluid inlet and the fluid outlet.

The present invention provides, among other features, improved heat transfer, reduced pressure drop, and reduced jitter. The present invention can be implemented for laminar flow and/or turbulent flow environments.

Additional embodiments, features, and advantages of the invention will be set forth in the description that follows. Yet further features and advantages will be apparent to a person skilled in the art based on the description set forth herein or may be learned by practice of the invention. The advantages of the invention will be realized and attained by the structure particularly pointed out in the written description and claims hereof as well as the appended drawings.

It is to be understood that both the foregoing summary and the following detailed description are exemplary and are intended to provide a non-limiting explanation of the invention as claimed.

BRIEF DESCRIPTION OF THE DRAWINGS/FIGURES

The present invention will be described with reference to the accompanying drawings, wherein like reference numbers indicate identical or functionally similar elements. Also, the leftmost digit(s) of the reference numbers identify the drawings in which the associated elements are first introduced.

Figure 3:
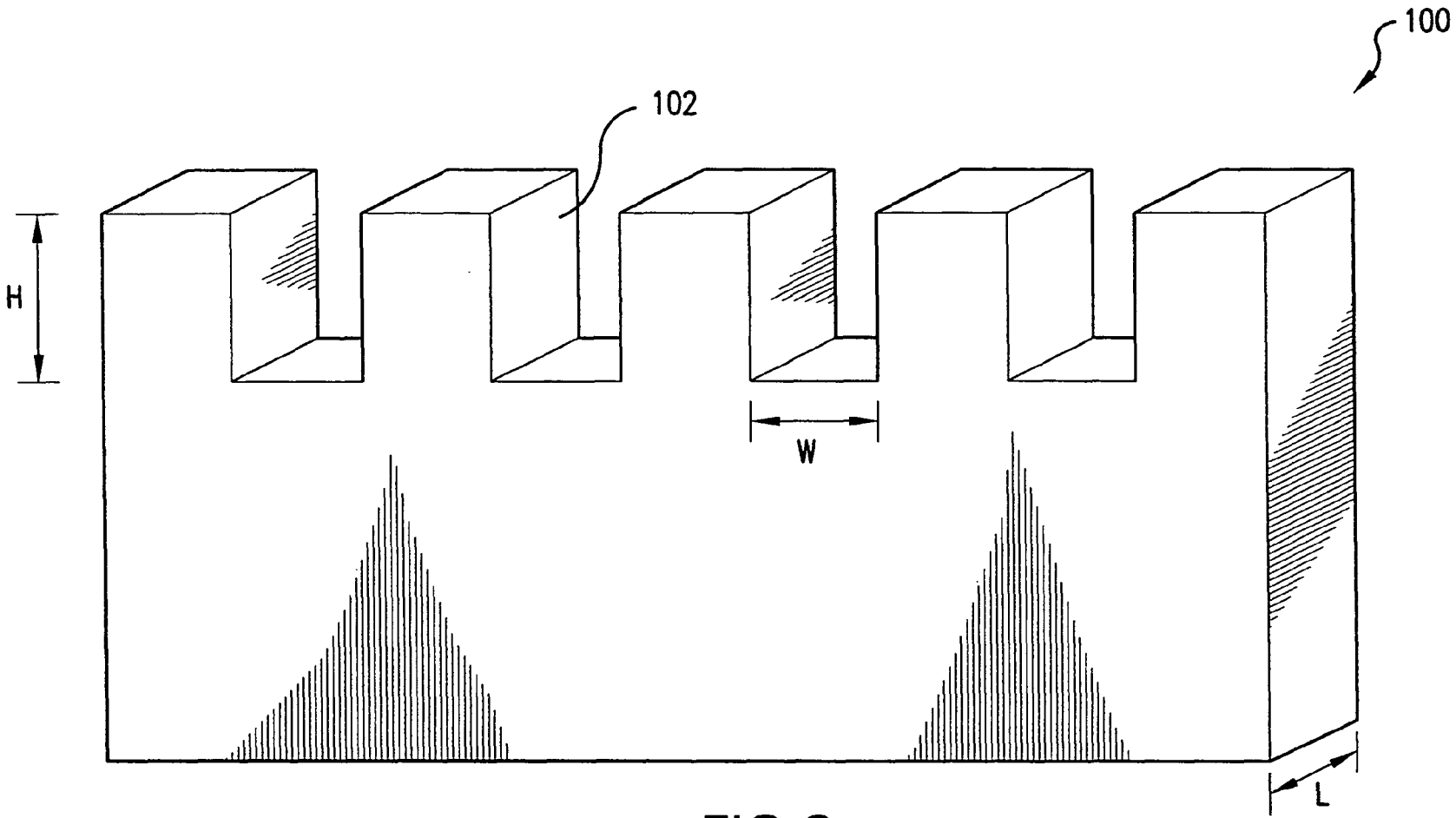

FIG. 3 is a front plan view of the plate 100 having a plurality of channels 102 formed along an edge of the plate 100.

Figure 4:
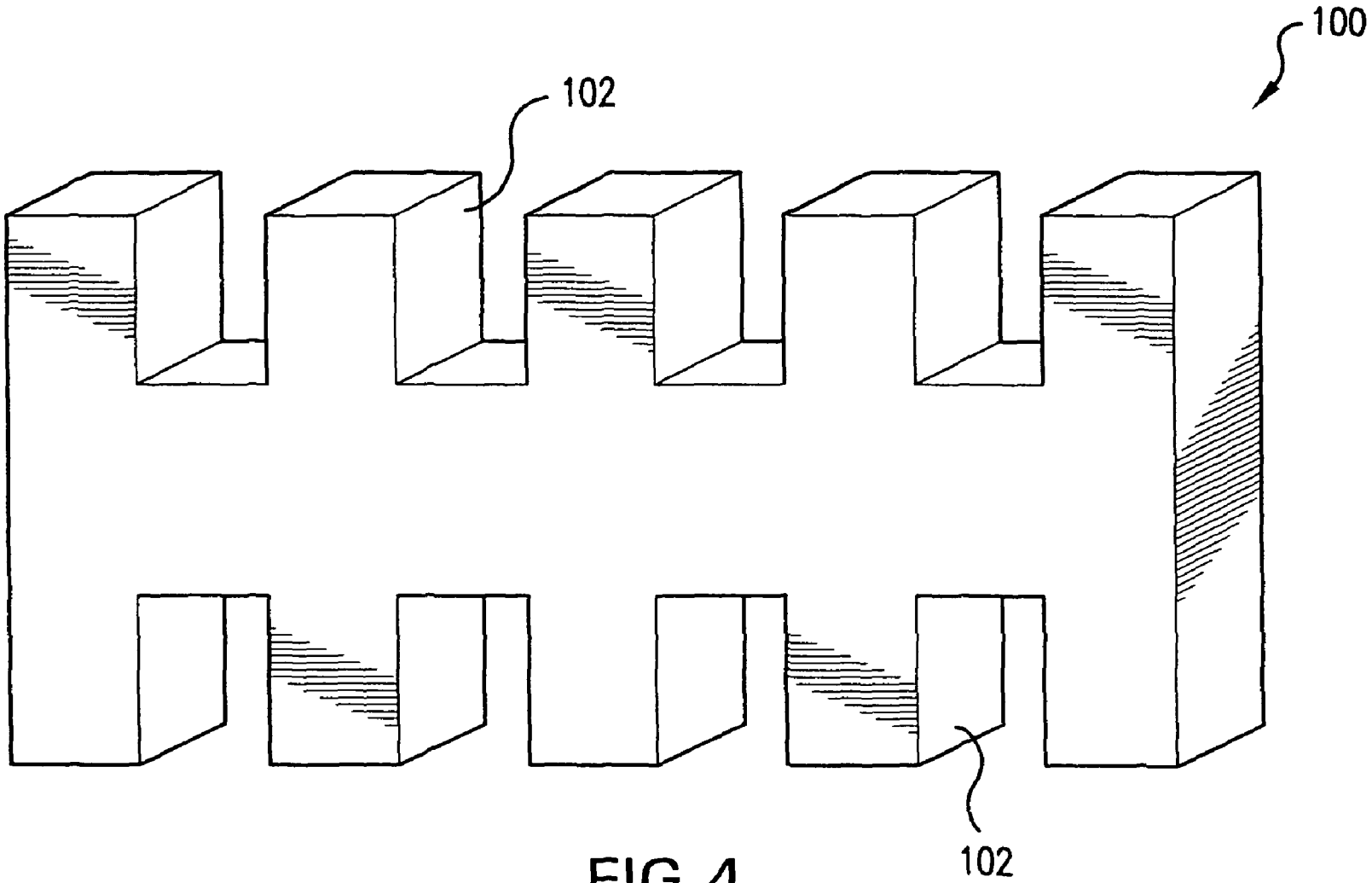

FIG. 4 is a front plan view of the plate 100 having a plurality of channels 102 formed along two opposite edges of the plate 100.

Figure 5:
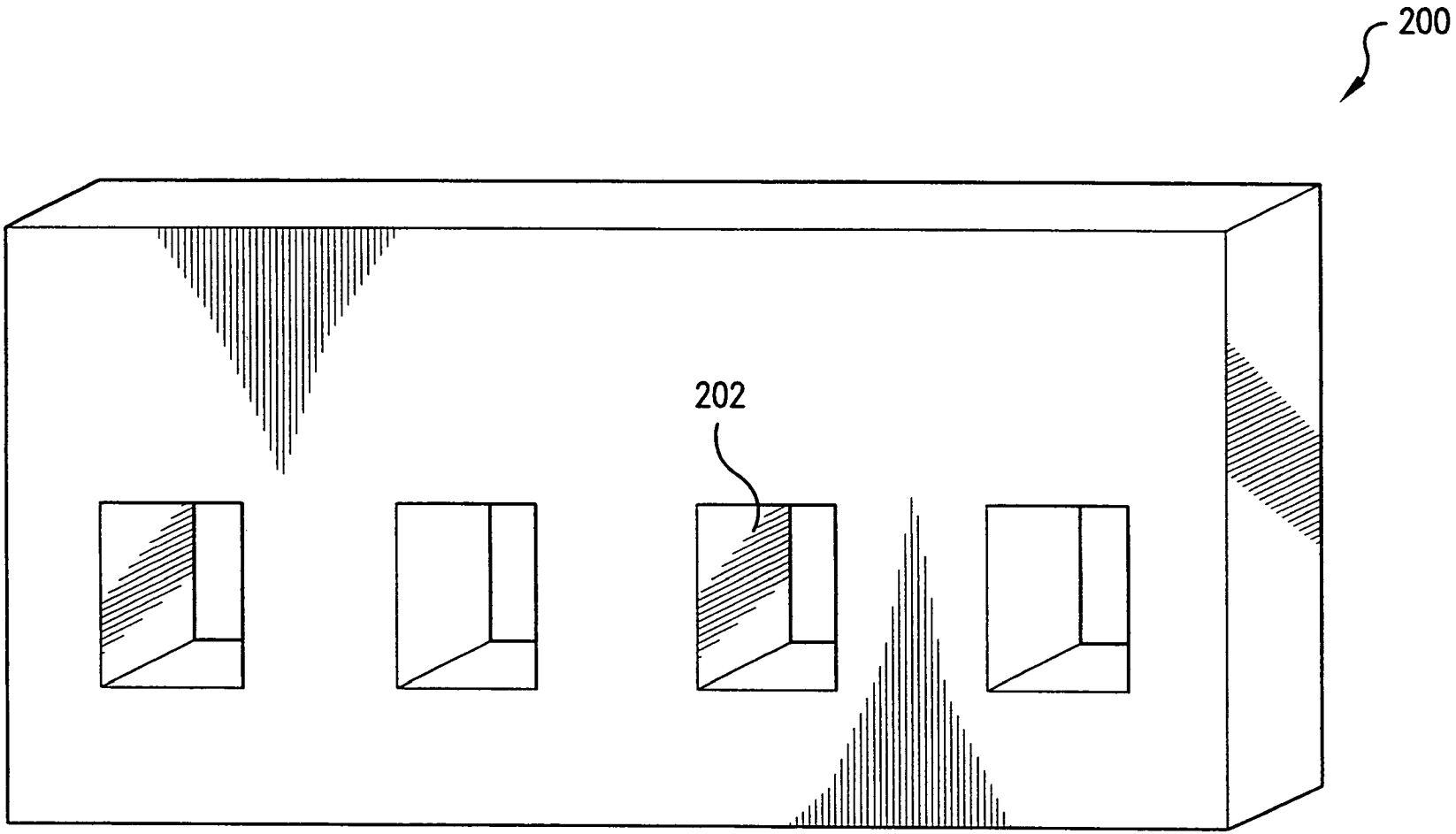

FIG. 5 is a front plan view of the plate 200 having a plurality of channels 202 formed through the plate 200.

Figure 6:
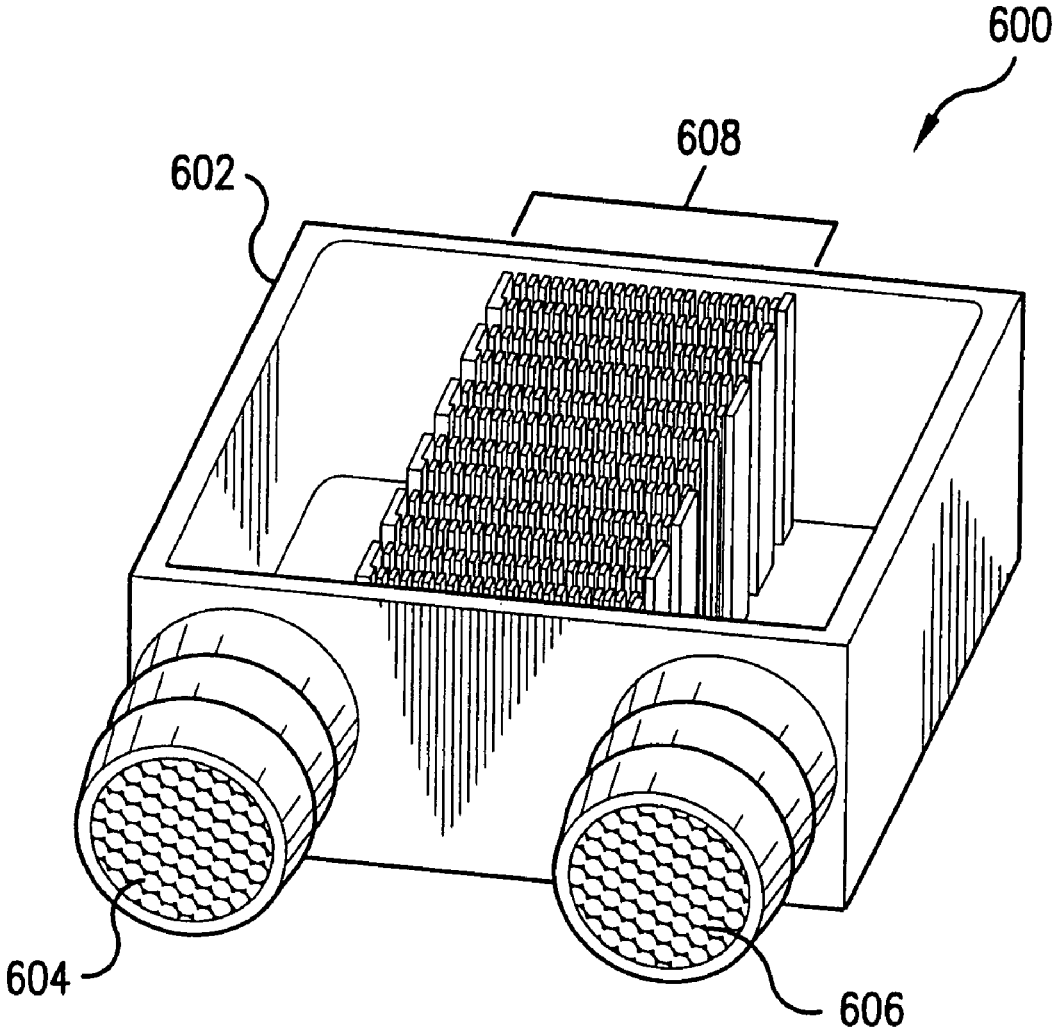

FIG. 6 is a top plan cut-away view of a heat exchanger 600, including a housing 602, an inlet 604, an outlet 606, and a heat exchanger core 608, in accordance with an embodiment of the invention.

Figure 7:
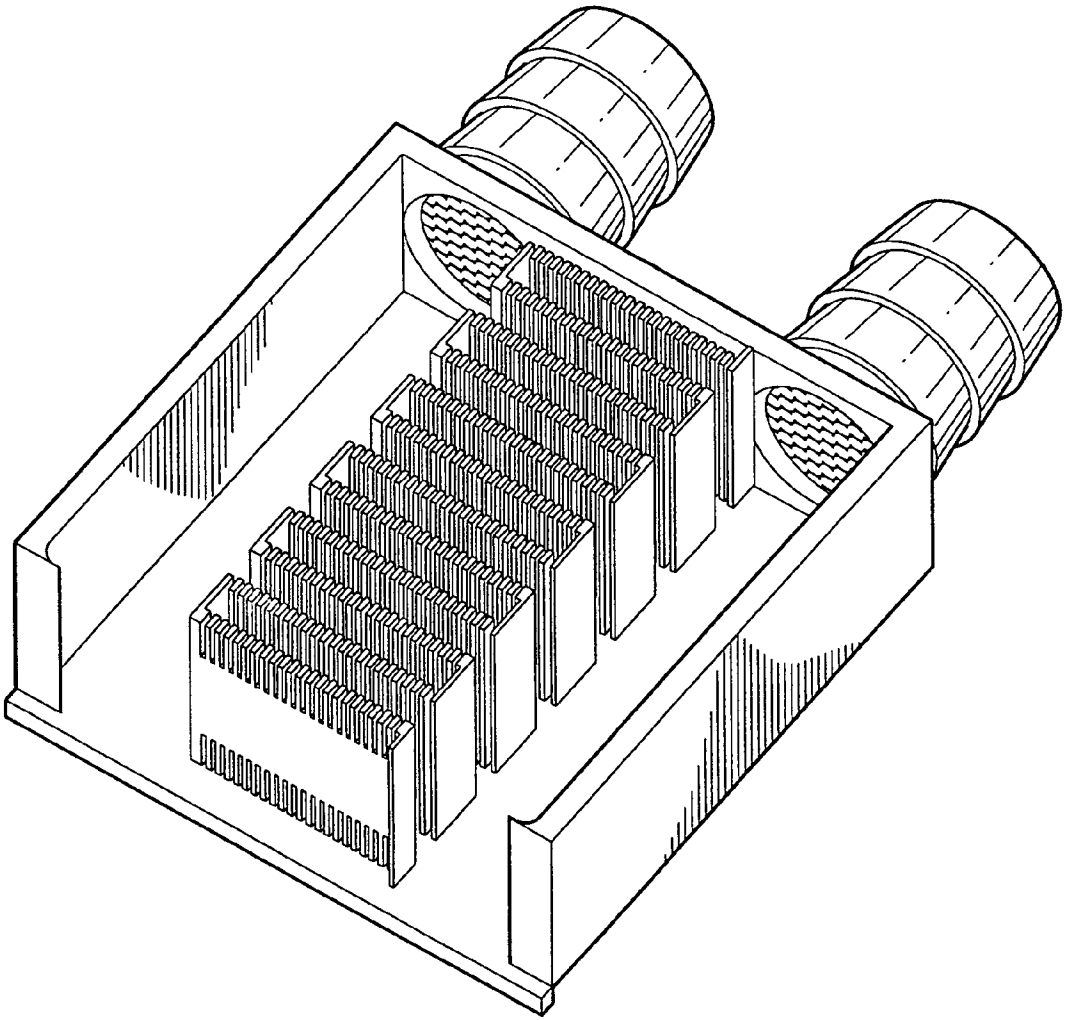

FIG. 7 is another top plan cut-away view of the heat exchanger 600.

Figure 8:
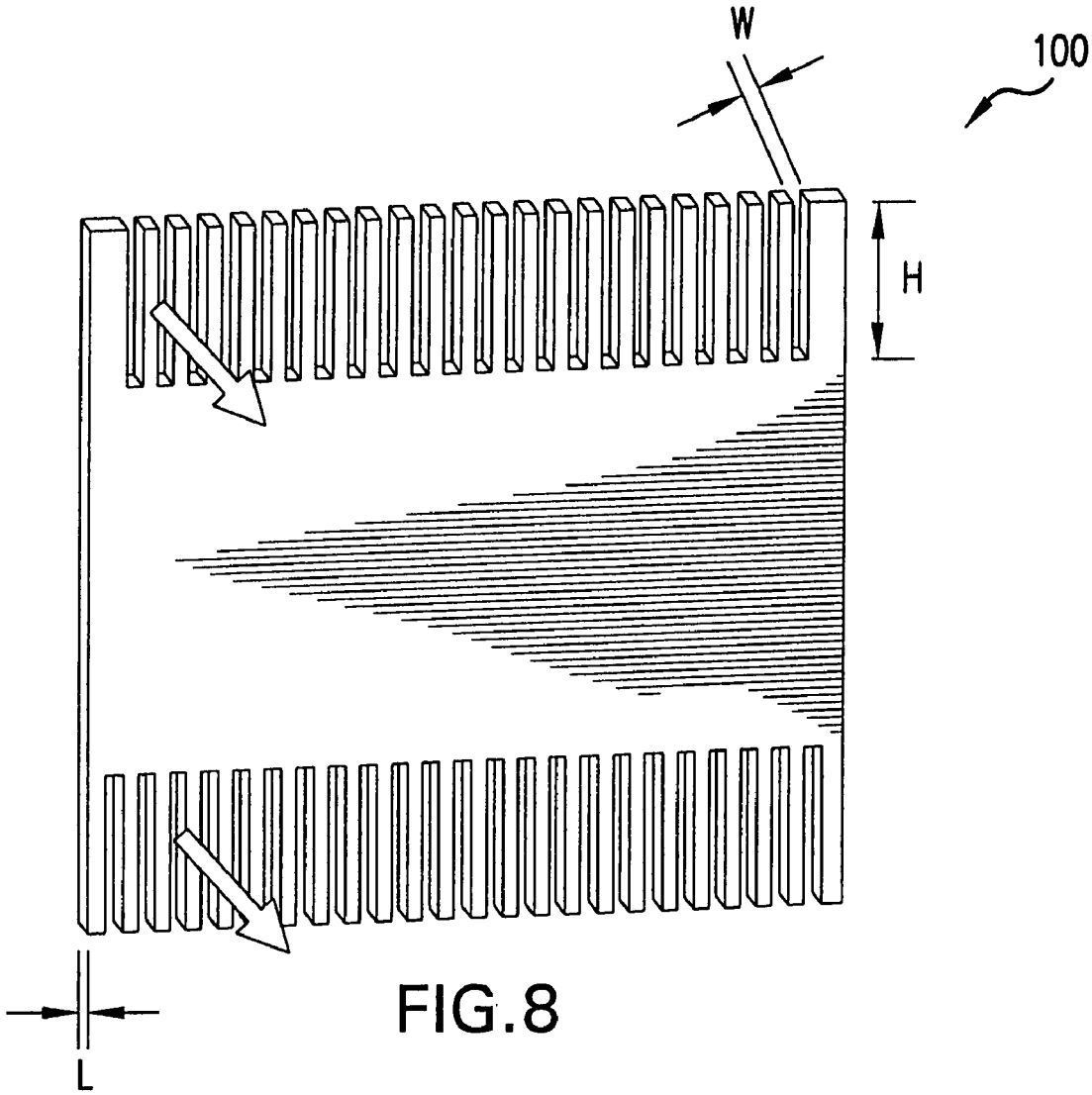

FIG. 8 is another front plan view of the plate 100 illustrated in FIG. 4.

Figure 9:
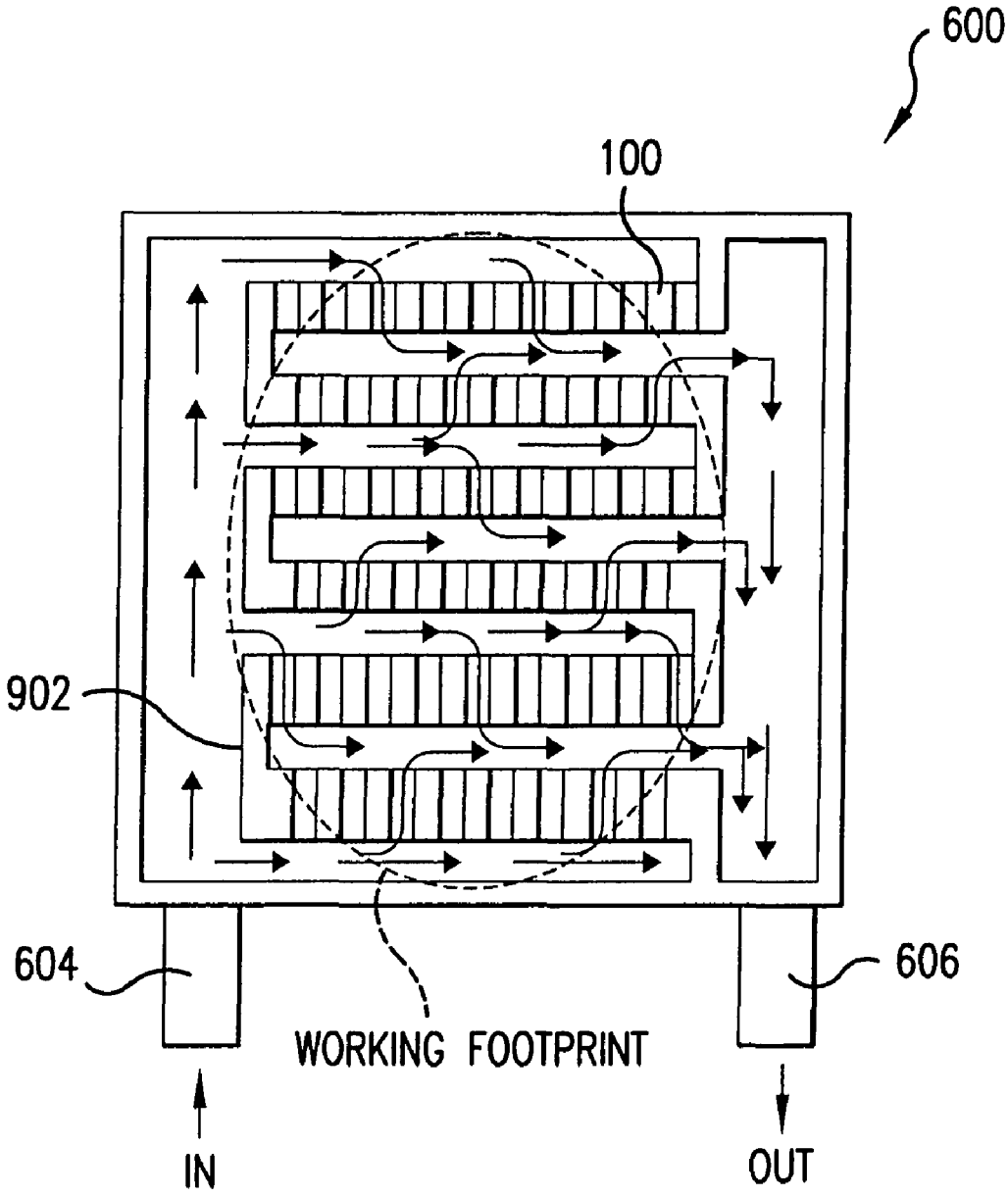

FIG. 9 is a top look-down cut-away view of the heat exchanger 300, wherein the heat conducting plates 100 are coupled together with end-plates 902.

Figure 10:
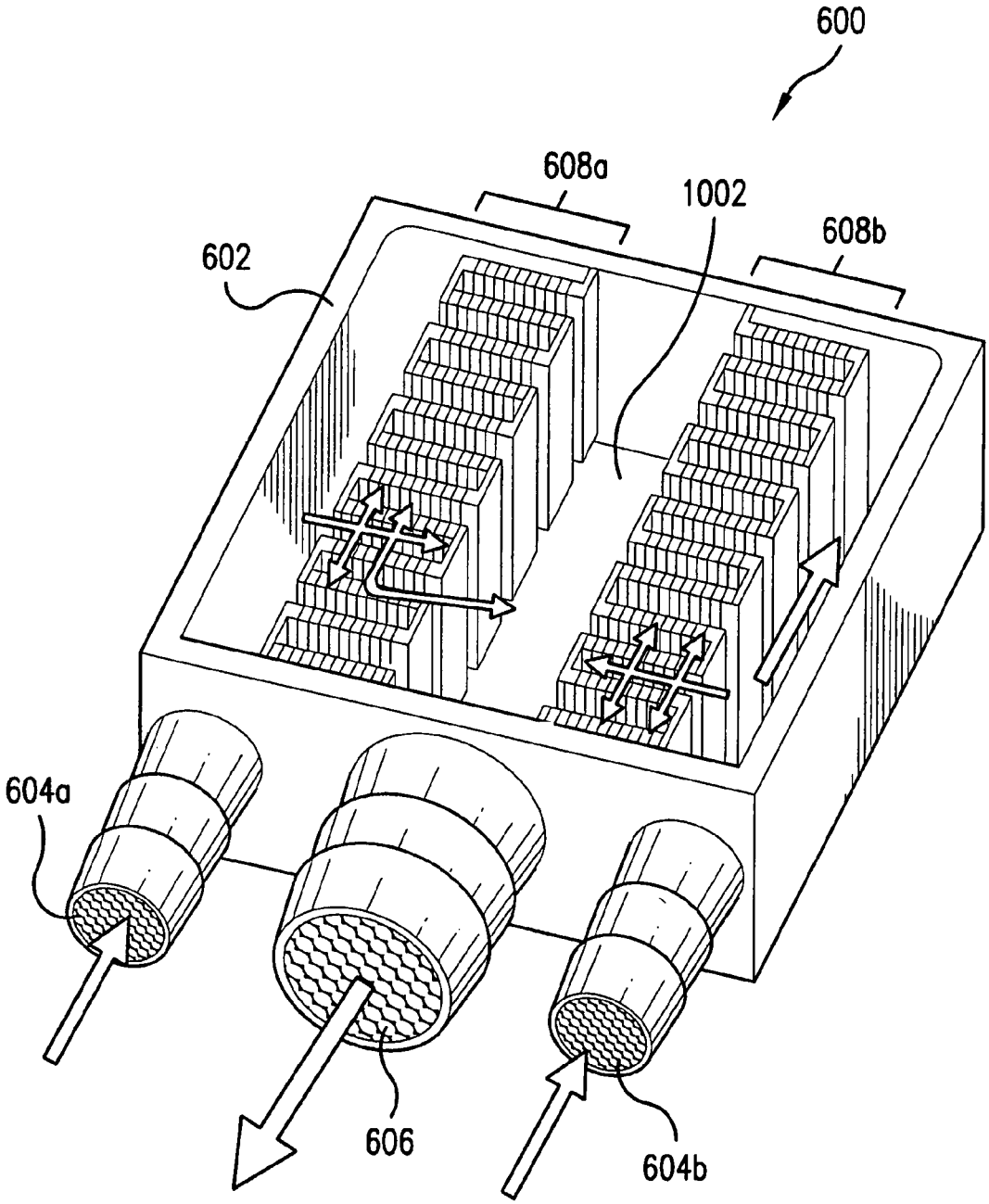

FIG. 10 is a top plan cut-away view of the heat exchanger 600, further including dual cores 608*a* and 608*b*.

Figure 11:
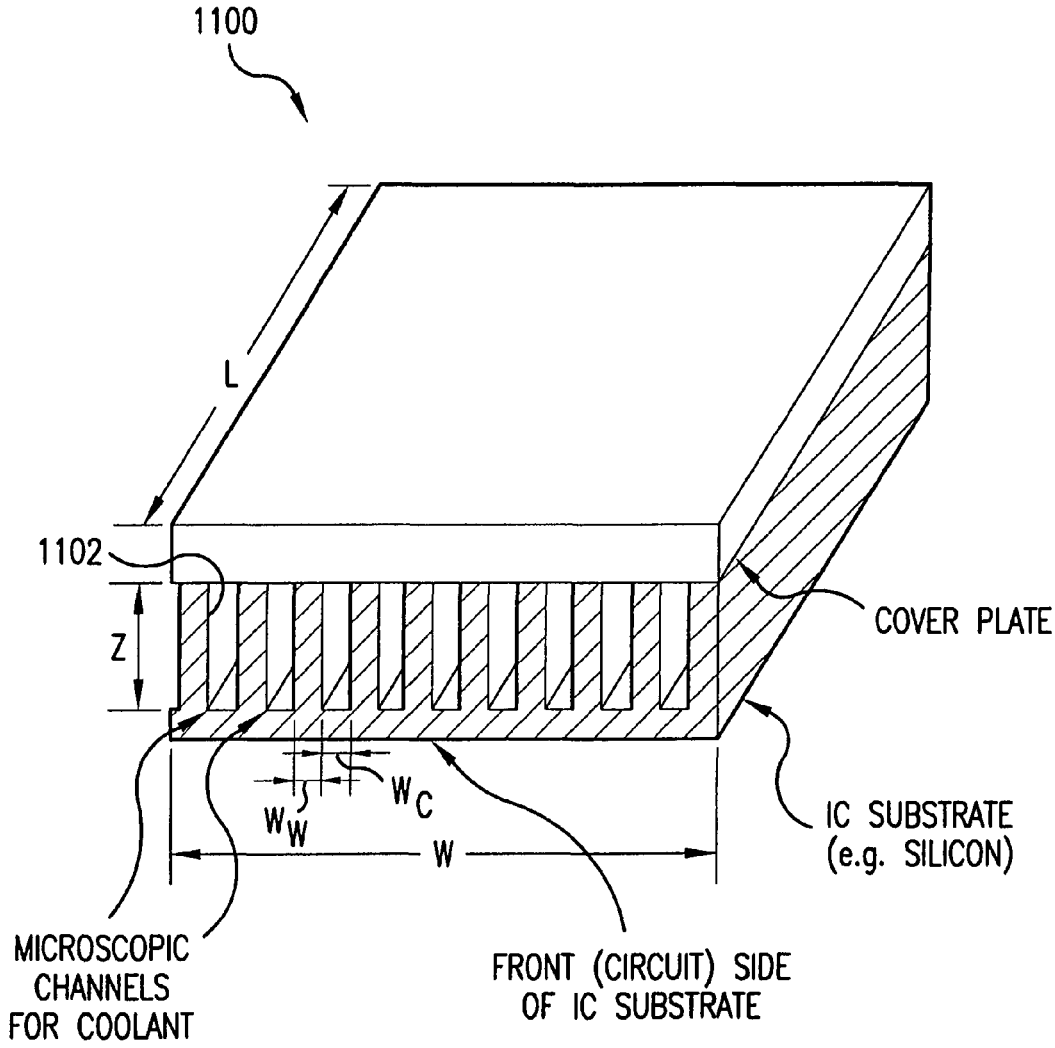

FIG. 11 is a front plan view of a conventional heat exchanger 1100.

Figure 12:
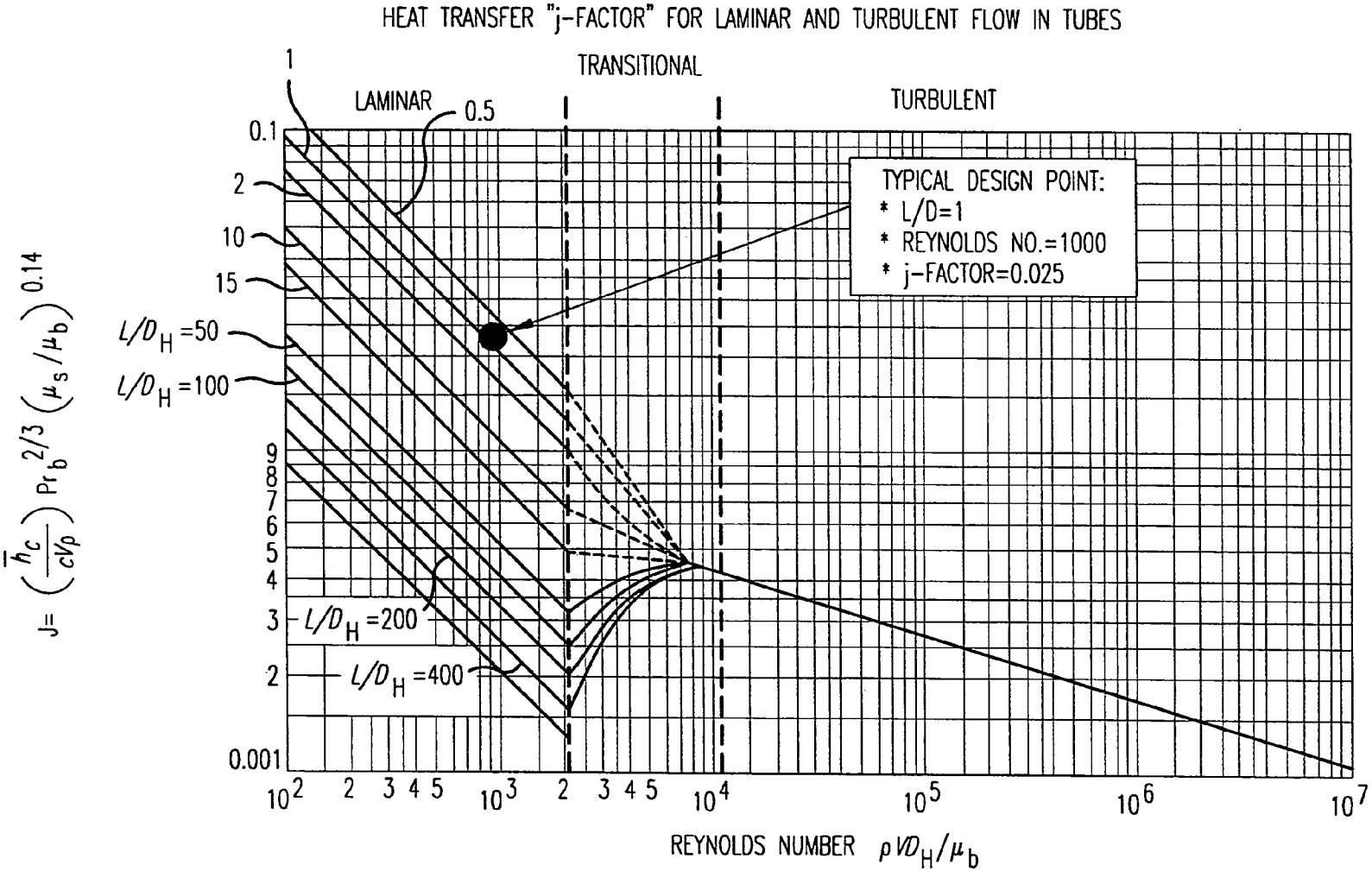

FIG. 12 is a graph showing thermal performance of the present invention.

Figure 13:
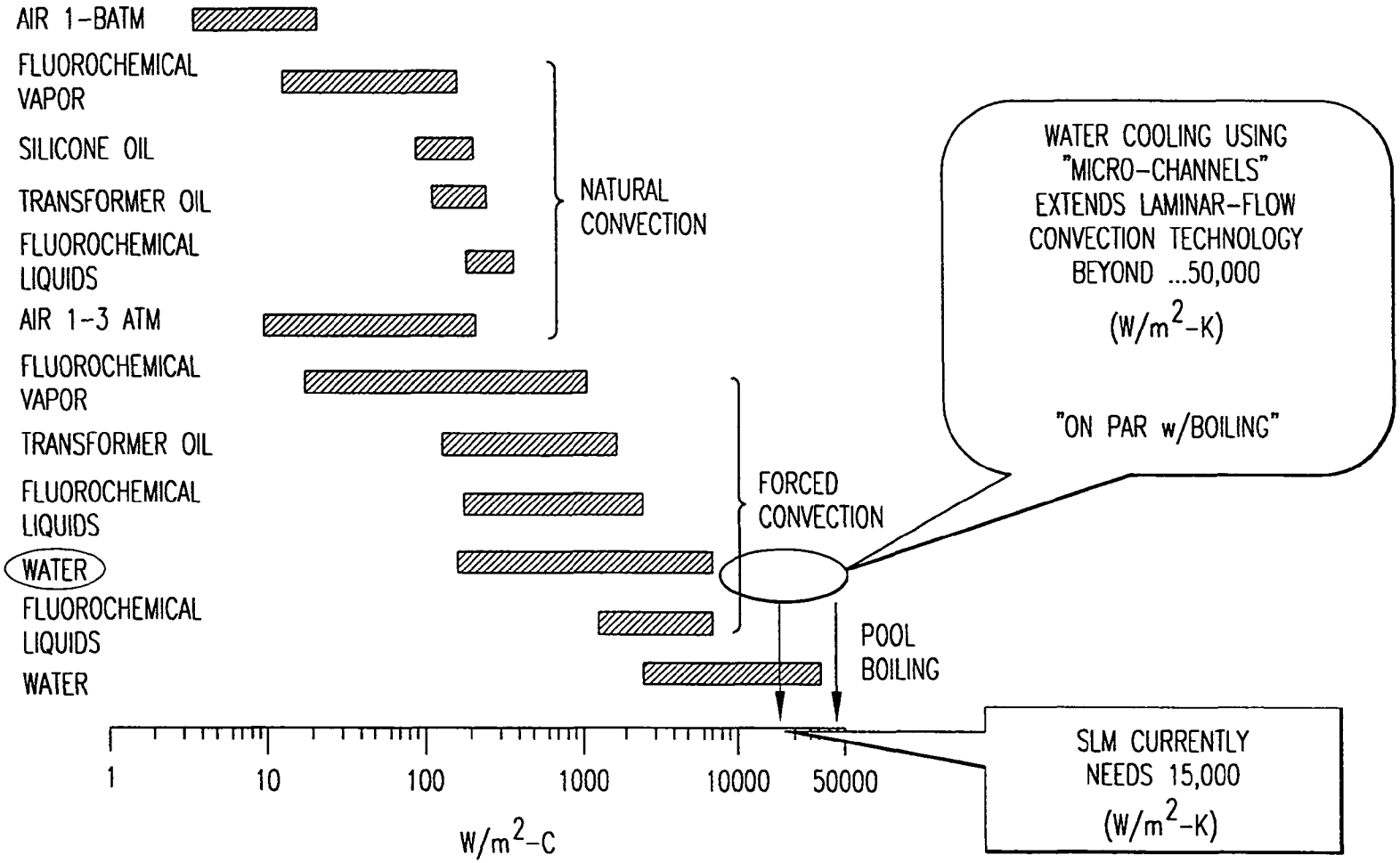

FIG. 13 is a graph showing how thermal performance values for the present invention are achieved.

Figure 14:
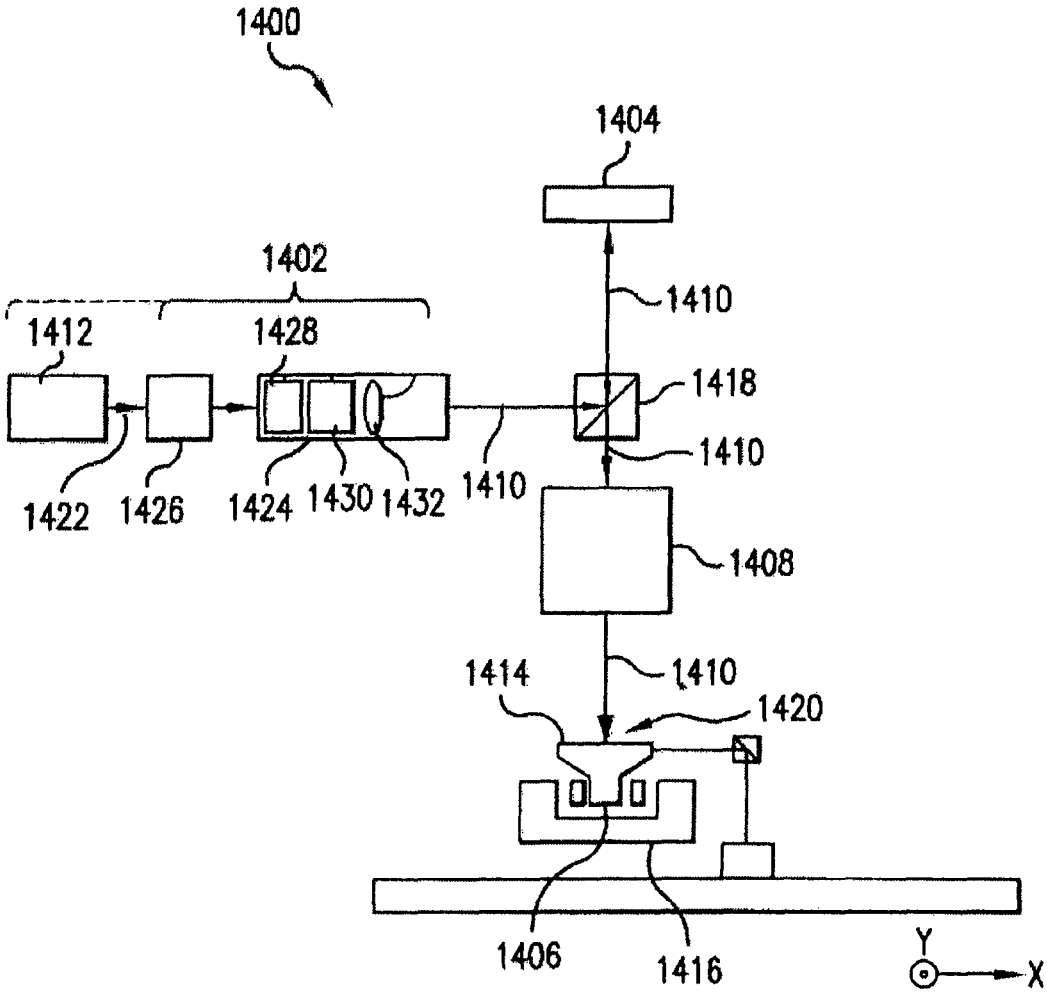

FIG. 14 is a block diagram of an example lithographic apparatus.

Figure 15:
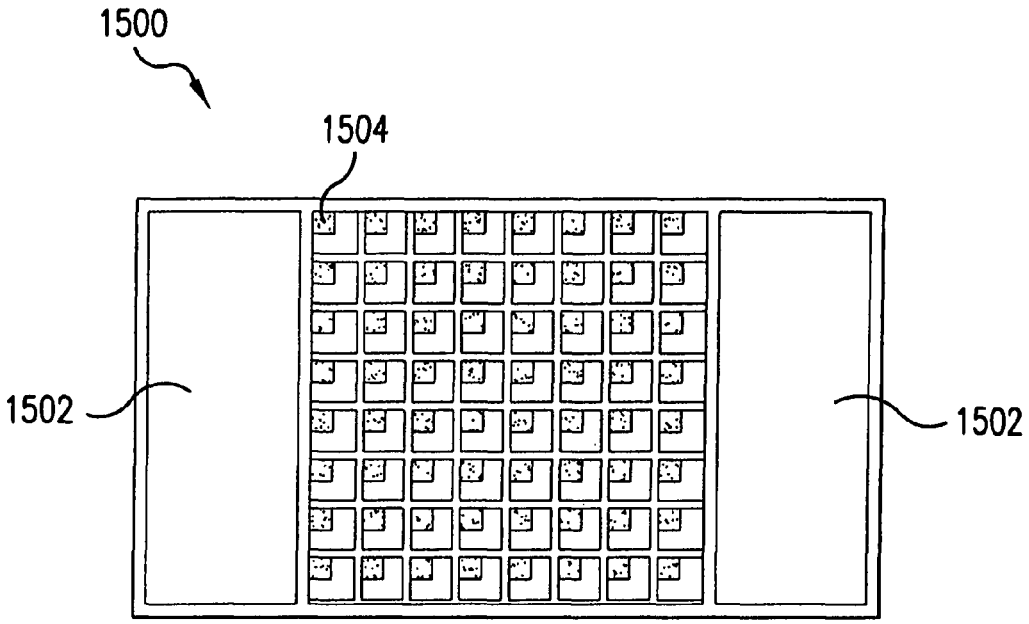

FIG. 15 is a top plan view of an example array of spatial light modulators.

Figure 16:
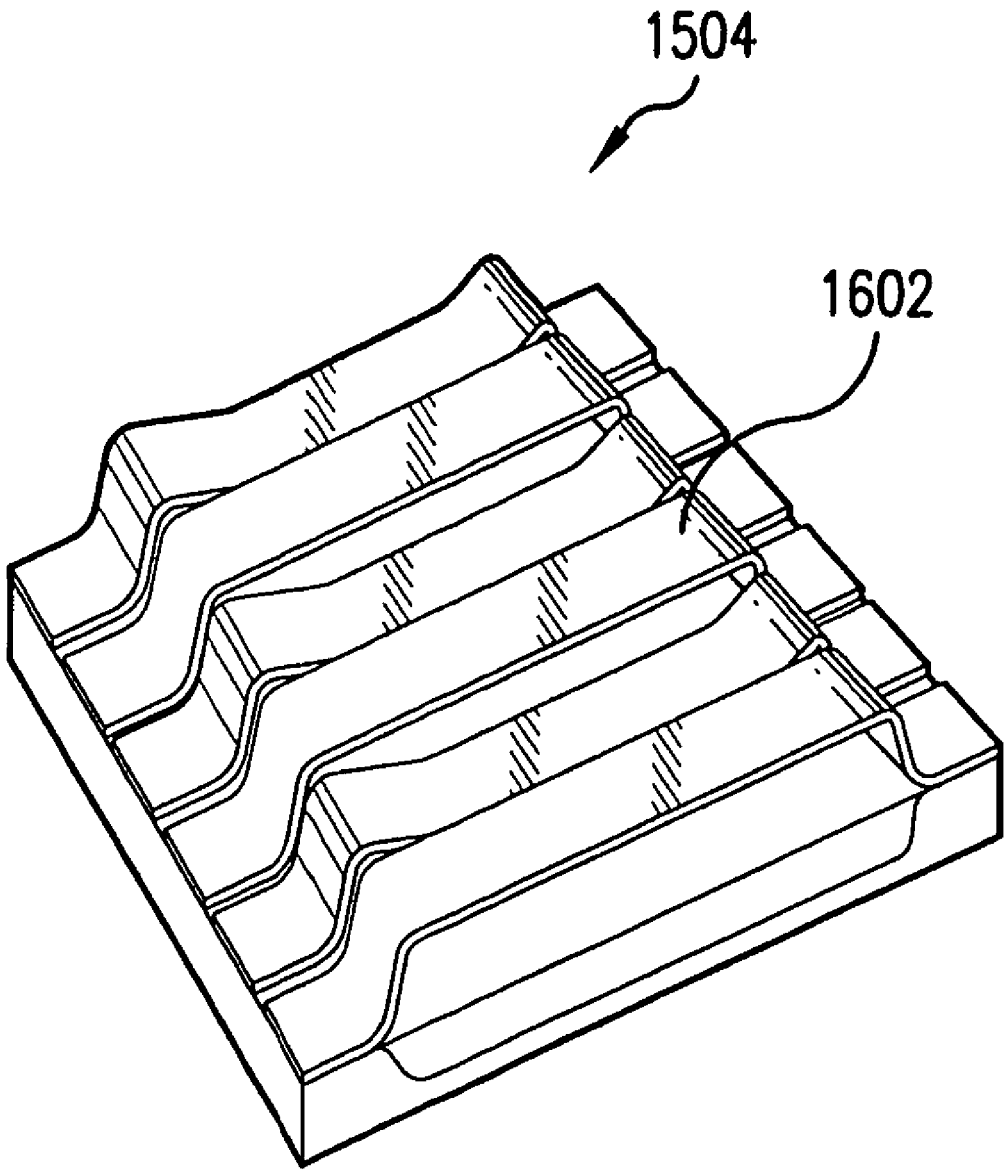

FIG. 16 is a top plan view of an example element of an array of spatial light modulators.

Figure 17:
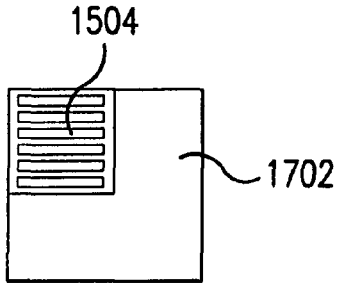

FIG. 17 is another look-down plan view of an example element of an array of spatial light modulators.

Figure 18:
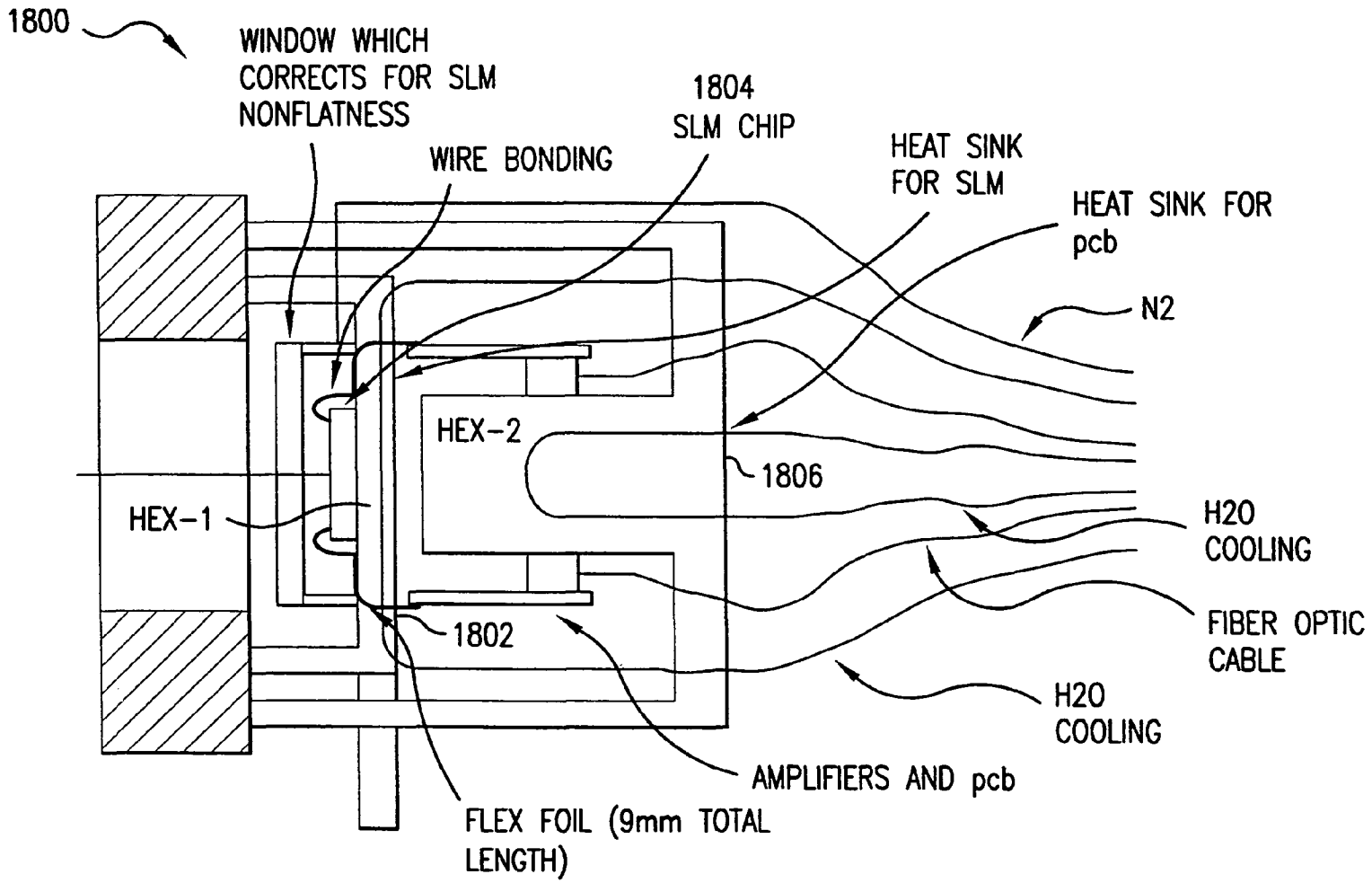

FIG. 18 is a block diagram of an SLM/heat-exchanger system 1800 that utilizes a first heat exchanger 1802 to cool an SLM 1804, and a second heat exchanger 1806 to cool circuitry associated with the SLM 1804, in accordance with an aspect of the invention.

Figure 19:
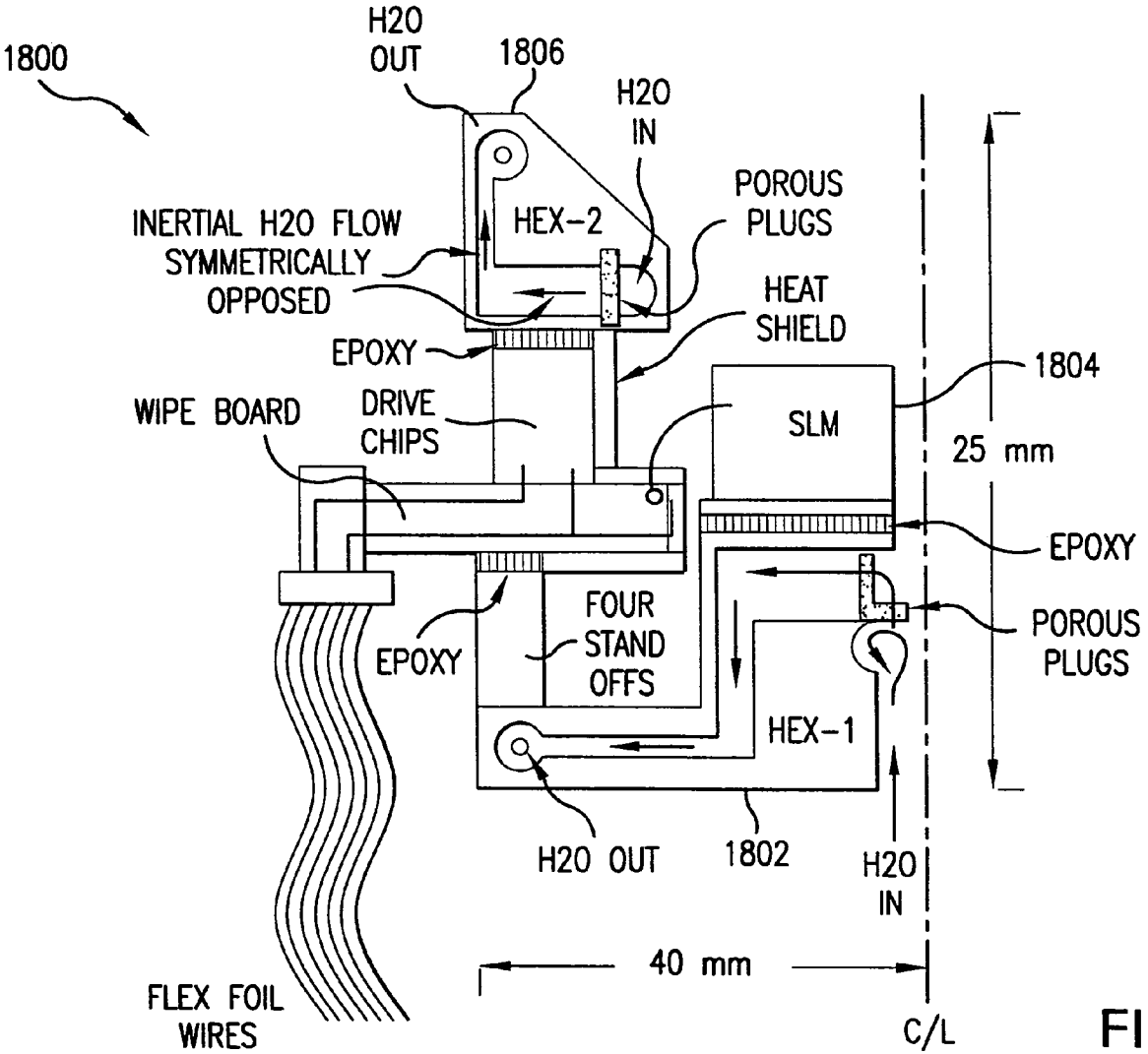

FIG. 19 is another block diagram of the SLM/heat-exchanger system 1800, in accordance with an aspect of the invention.

DETAILED DESCRIPTION OF THE INVENTION

I. Introduction

The present invention is directed to micro-channel heat exchangers, including reduced flow micro-channel heat exchangers having improved laminar flow to reduce or eliminate jitter.

The present invention is described herein as implemented in a spatial light modulator ("SLM") environment. The invention is not, however, limited to SLM environments. Based on the description herein, one skilled in the relevant art(s) will understand that the invention can be implemented in a variety of environments where heat exchanging is desired.

In maskless lithography, high-density electronic packaging techniques are used to arrange many SLM chips in a desired optical pattern. SLMs typically require ancillary drivers, amplifiers, digital-to-analog boards, and a plethora of connections and wiring. As a result, it is difficult to optimize packaging design density. Furthermore, as SLM packaging densities increase, the complications of managing cooling requirements increase proportionally.

The present invention provides a compact, micro-channel, liquid cooled heat exchanger solution.

An early micro-channel, laminar heat exchanger concept is presented in, D. B. Tuckerman and R. F. W. Pease, "High-Performance Heat Sinking for VLSI," IEEE Electron Device Letters, Vol. EDL-2, No. 5, May 1981, (hereinafter, "Tuckerman"), which is incorporated herein by reference in its entirety. Tuckerman demonstrates the ability to generate relatively high heat removal rates using compact heat exchanger systems made of finely etched silicon micro-channels. Tuckerman shows that these micro-channels are capable of absorbing an unconventionally large amount of heat using laminar flowing fluids. Prior to this, only macroscopic heat exchanger technology, using turbulent flows, were capable of absorbing the level of heat flux density demonstrated by Tuckerman.

Tuckerman envisioned combining the newly arrived capability of etching silicon material to form micro-channels, with the esoteric heat transfer principle of the "j-factor" as applied to laminar flow. The "j-factor" is described below. This resulted in high-performance heat-flux absorption capability when using fully developed laminar flow in micro-channels.

The "j-factor" is well known to those skilled in the art of heat transfer and thermodynamics. The "j-factor" stands for a combination of three non-dimensionalized heat transfer parameters multiplied together. Each parameter was given an honorarium name after the engineer/scientist who developed it. The "j-factor" is a "non-dimensionalized" measure of the capacity to transfer heat between two points. The larger the j-factor the greater its potential to transfer heat.

The j-factor=Stanton Number×Colburn 'J-Factor'×Viscous Correction Factor, where:

the Stanton Number=Nusselt Number divided by both Reynolds and Prandtl Numbers;

the Colburn 'J-Factor'=Prandtl Number raised to the "⅔" power; and the Viscous Correction Factor=The Heat Transfer Fluid's (air or liquid) Viscosity Ratio Between its value measured at the wall temperature to its value at the fluid's 'bulk' temperature. This ratio is then raised to the 0.14 power.

FIG. 11 is a front plan view of a conventional heat exchanger 1100, reproduced from Tuckerman. The heat exchanger 1100 has an overall dimension of 10 millimeters long (l), by 10 millimeters wide (w), by 0.6 millimeters high (h). The heat exchanger 100 includes a plurality of fluid conducting channels 1102. Each channel is 10 millimeters long, 57 micrometers wide, and 365 micrometers high, with 57 micrometers of substrate material between each channel 1102. Tuckerman's dimensions allow for only 88 cooling flow channels in a heat exchanger.

The micro-channels 1102 in Tuckerman have relatively large characteristic aspect ratios, such as a height/width ratio on the order of 6 to 10, and a channel length (L) to hydraulic diameter (D) ratio of approximately 100. The significance of the L/D ratio is described below. Tuckerman's micro-channels run the full length of the heat exchanger (i.e., several centimeters), to produce sufficient surface area for heat load absorption.

The present invention applies a geometrically derived paradigm shift to change the overall shape and nature of the Tuckerman micro-channel heat exchanger. As a result, the present invention increases the heat absorbing capability by an order of magnitude, while using less flow and exhibiting relatively dramatic reductions in pressure drop. The invention also improves on the esoteric laminar flow concept originally identified by Tuckernan, to obtain a factor of 10 enhancement of the laminar heat transfer rate, while maintaining constant Reynold's number.

The present invention recognizes the importance of the channel length (L) to hydraulic diameter (D) ratio on the heat transfer characteristics of a heat exchanger. This is described as follows. As liquid flows through the channels, molecules of the liquid come in contact with surfaces of the channels. When the molecules come into contact with the surfaces of the channel, heat is exchanged from the surfaces of the channels to the liquid.

The inventors have determined that a substantial number of the molecules come into contact with the surface of the channel within a relatively short distance of the entrance of the channel. In other words, near the entrance of a channel, the molecules of the liquid move around, exchanging positions, so that a substantial portion of the molecules will have contacted and exchanged heat with the surface within a relatively short distance of the entrance to the channel. Beyond that distance, however, fewer molecules exchange positions. As a result, less heat exchange occurs further down the channel.

Consequently, the inventors have determined that reducing channel length to hydraulic diameter (L/D) ratio, improves the heat transfer characteristics of a micro-channel heat exchanger. Whereas the Tuckerman heat exchanger had an L/D ratio around 100, the present invention provides L/D ratios below 100, including, without limitation, L/D ratios of 2 and L/D ratios near unity.

As noted above, the present invention can be implemented to reduce the required flow rate and Reynold's number by a factor of 10, while maintaining comparable heat transfer performance. Such reductions in flow rate reduce system pressure loss as well. Pressure loss of the Tuckerman heat exchanger measured on the order of 15 to 30 pounds per square inch ("psi"). Loss reductions follow the square of velocity law. Thus, at one tenth the flow relative to the Tuckerman heat exchanger, for example, the present invention yields a factor of 100 reduction in pressure drop, or values of from 0.15 to 0.30 psi.

Applying the geometric paradigm shift in accordance with the present invention, many more channels can be fabricated within a given dimension. This is because channels in accordance with the present invention are typically shorter than taught by Tuckerman. This allows more channels to fit within a given space. Any number of channels can be implemented within a heat exchanger, depending on the desired heat transfer characteristics. Example implementations are provided below, followed by example dimensions. The invention is not, however, limited to the example implementations and example dimensions provided herein. Based on the teachings herein, one skilled in the relevant art(s) will understand that other implementations and/or other dimensions can be implemented.

II. Example Implementations

The present invention can be implemented with a heat conducting plate having one or more channels formed therein, wherein the channels have a relatively low L/D ratio. A heat exchanger in accordance with the invention includes one or more of the heat conducting plates. As the number of channels increases, (e.g., the number of channels per plate and/or the number of plates in the heat exchanger), the heat transfer capabilities of the system increase.

FIGS. 1-10 illustrate exemplary aspects of the present invention. The examples of FIGS. 1-10 embellish the geometric cooling concept to yield L/D ratios near unity and demonstrate how one applies these geometric principles to increase heat transfer performance. An example heat exchanger typically measures, for example, from 25 to 250 mm on a side, with a thickness from 6 to 25 mm, and contain a relatively complex central structure or footprint for delivering the high heat transfer rates. The invention is not, however, limited to the example dimensions provided herein.

Figure 1:
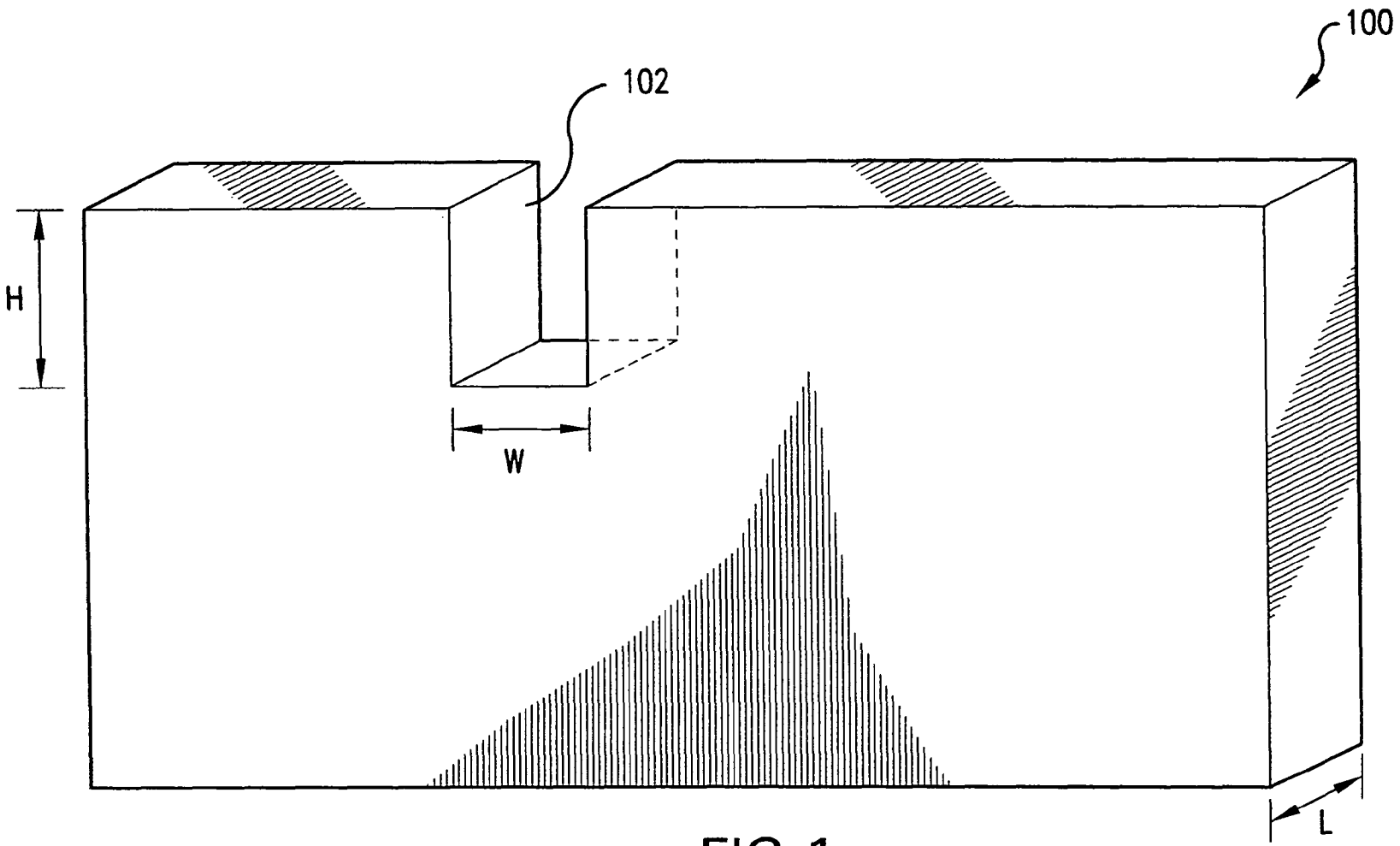
FIG. 1 is a front plan view of an example heat conducting plate 100 having a channel 102 formed therein, in accordance with an embodiment of the invention.
Figure 2:
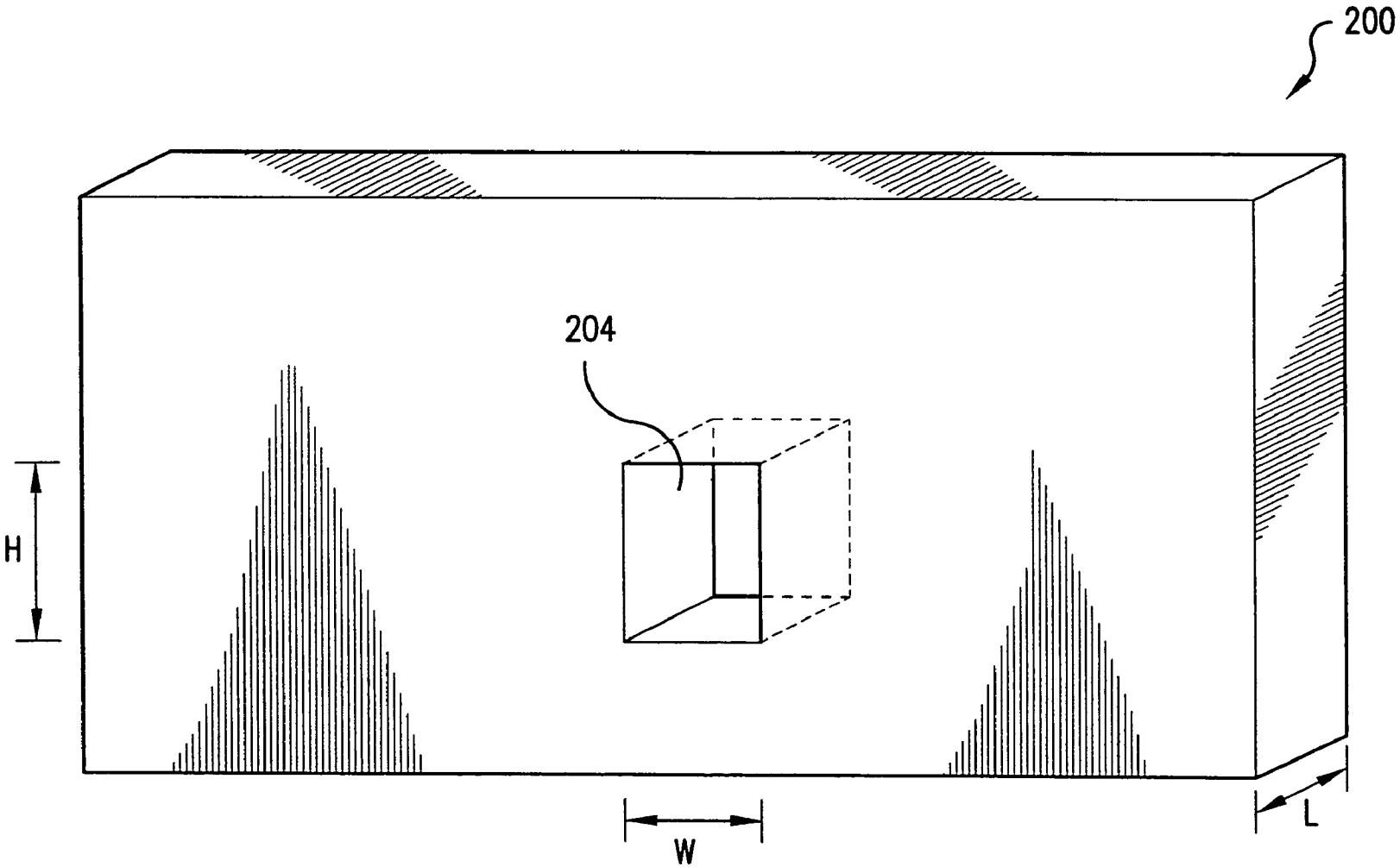
FIG. 2 is front plan view of a heat conducting plate 200 having a channel 202 formed therethrough, in accordance with an embodiment of the invention.

FIG. 1 is a front plan view of an example heat conducting plate 100 having a channel 102 formed therein. FIG. 2 is front plan view of a heat conducting plate 200 having a channel 204 formed therethrough. The heat conducting plates 100 and 200 are fabricated from any of a variety of materials and/or combinations thereof, as described above.

In operation, as liquid flows through the channel 102 and/or 204, molecules of the liquid come in contact with surfaces of the channel. When the molecules come into contact with the surfaces of the channel, heat is exchanged from the heat conducting plate to the liquid.

In the examples of FIGS. 1 and 2, the channels 102 and 204 have a width (W), a height (H), and a length (L). The width, height, and length are sized for a desired L/D ratio, where D represents the hydraulic definition of diameter. For a typical micro-channel, D is given as follows:

$$D=2*W*H/(W+H) \quad \text{(Eq. 1)}$$

In many embodiments, an optimal L/D ratio is near unity. The invention is not, however, limited to L/D ratios of unity. L/D ratios above and below unity can be utilized.

In the examples of FIGS. 1 and 2, the channels 102 and 204 have a rectangular shape. Alternatively, or additionally, the channels can be implemented with other shapes, such as circular, oval, or polygonal.

In order to increase the heat transfer capabilities, a plurality of channels 102 and/or 204 can be utilized. For example, FIG. 3 is a front plan view of the plate 100 having a plurality of channels 102 formed along an edge of the plate 100. FIG. 4 is a front plan view of the plate 100 having a plurality of channels 102 formed along two opposite edges of the plate 100. FIG. 8 is another front plan view of the plate 100 illustrated in FIG. 4. FIG. 5 is a front plan view of the plate 200 having a plurality of channels 204 formed through the plate 200. The invention is not, however, limited to these examples of multiple channels. Based on the description herein, one skilled in the relevant art(s) will understand that multiple channels 102 and/or 204 can be implemented in any of a variety of patterns.

In the examples of FIGS. 1-5 and 8, the plates are illustrated with a square or rectangular face. The invention is not, however, limited to this shape. Based on the description herein, one skilled in the relevant art(s) will understand that the plates can be implemented in any of a variety of shapes. For example, and without limitation, the plate 100 and/or 200 can be circular or oval shaped, with channels 102 formed along the outer edge of the plate and/or with channels 204 formed therein. One or more such circular or oval shaped plates can be placed within a tubular-like heat conducting body, through which a coolant liquid flows.

In order to further increase the heat transfer capabilities, a plurality of plates are utilized. For example, FIGS. 6 and 7 are top plan cut-away views of a heat exchanger 600, including a housing 602, an inlet 604, an outlet 606, and a heat exchanger core 608. The heat exchanger core 608 includes a plurality of heat conducting plates 100 coupled together in an accordion fashion as described below with reference to FIG. 9. The accordion-style implementation allows a number of heat conducting plates to be positioned in a relatively small space. The invention is not, however, limited to accordion-style implementations. Based on the description herein, one skilled in the relevant art(s) will understand that other multiple-plate implementations can be implemented as well.

In FIGS. 6 and 7, a housing cover (not shown) contacts an edge of the heat conducting plates 100 to enclose the tops of the channels 102. The core 608, as well as the entire cavity within the housing 602, are optionally bathed in coolant fluid for thermal stability.

FIG. 9 is a top look-down cut-away view of the heat exchanger 600, wherein the heat conducting plates 100 are coupled together with end-plates 902. Arrows indicate the direction of coolant flow.

Optional weep holes are formed in the end plates 902 to allow for the cooler fluid to mix with and cool the hotter fluids prior to exiting the module. Optional weep holes are illustrated in FIG. 10, which is discussed below.

Referring back to FIG. 6, the inlet 604 and/or the outlet 606 optionally include honeycomb flow regulators to maintain laminar conditions with virtually no jitter.

FIG. 10 is a top plan cut-away view of the heat exchanger 600, further including dual cores 608*a* and 608*b*. In this example, coolant fluid enters a center cavity 1002 through the inlets 604*a* and 604*b*, then passes through the cores 608*a* and 608*b*, and out outlet 606.

The examples above illustrate the mazes of walls/combs that orient the coolant for distribution through the tiny, microscopic channels. The channels can number in the hundreds to the tens-of-thousands, depending upon the thermal requirement. Collectively, the channels provide several orders of magnitude increase in heat transfer contact surface area over conventional macro or even other types of micro-heat-exchangers on the market.

The outer feed/return perimeter as well as the heat exchanger core are optionally bathed in refreshed coolant for thermal stability.

III. Example Dimensions

A heat exchanger in accordance with the invention can be implemented with various numbers of channels having one or more of a variety of dimensions, provided that the L/D ratio is below 100, typically as low as unity or below. Example numbers of channels and dimensions of the channels are provided below for exemplary purposes. The examples below utilize channels having lengths in the range of micrometers, below the 10 millimeters taught by Tuckerman. In order to obtain desired L/D ratios, the example channel widths and heights below are in the range of micrometers. The number of channels, on the other hand, is independent of the dimensions of the channels. Increasing the number of channels generally increases the heat transfer abilities of the heat exchanger. In addition, one or more of the channels can be sized differently from one another. The invention is not, however, limited to the example dimensions provided herein. Based on the teachings herein, one skilled in the relevant art(s) will understand that other dimension can be implemented.

In a first example embodiment, the heat exchanger is implemented with 5,850 flow channels, each channel being approximately 57 micrometers long, 75 micrometers wide, and 150 micrometers high, with 75 micrometers of substrate material between each channel. According to this embodiment, the L/D ratio is reduced to 2.

Decreasing the L/D ratio by a factor of 50 from Tuckerman increases the effective heat transfer coefficient by a factor of 10 for the same Reynold's number. This yields a factor of ten increase in heat absorbed. Furthermore, by increasing the number of channels by a factor of over 66 over Tuckerman, the capability to absorb heat is effectively increased another 66 times. In other words, this new concept has improved the total heat absorption capability of the Tuckerman micro-heat-exchanger by 660 times, for this example. The new heat exchanger concept performs at thermal levels comparable to phase change cooling systems, but without the need to boil or change phase of the coolant liquid.

In a second example embodiment of the present invention, which is provided by way of explanation not limitation, the heat exchanger is implemented with 1,470 flow channels, each 83 micrometers long, 57 micrometers wide, and 150 micrometers high, with 57 micrometers of substrate material between each channel. According to this embodiment, the L/D ratio is reduced to near unity. This decreases the L/D ratio by a factor of 100 over Tuckerman, and increases the effective heat transfer coefficient by a factor of 10 for the same Reynold's number. Overall yield is a factor of ten increase in heat absorbed. Plus, the number of channels is increased by a factor of over 17, thereby increasing the ability to absorb heat another 17 times. The invention thus improves the thermal performance of the Tuckerman heat exchanger by 170 times, in this example.

The invention is not, however, limited to the exemplary dimensions provided above. Additional features associated with one or more implementations of the invention are described below.

The invention provides relatively low pressure drops, of the order of tenths of psi, for most laminar flow applications, and of the order of several psi for turbulent applications.

The invention can be implemented as a high efficiency, laminar cooling heat exchanger that requires approximately one-tenth the cooling capacity of other types of micro-channel devices for comparable heat loads absorbed. The combination of reduced flow plus laminarity yields an extremely low jitter device.

The invention can be implemented to provide cooling symmetry to yield a symmetrical temperature distribution over the heat exchanger face while subjected to a uniform heat load.

A heat exchanger in accordance with the invention can be tailored to accommodate asymmetric heat loads, while providing surface temperature symmetry.

A heat exchanger in accordance with the invention can be configured to simultaneously absorb dual heat loads from both front and rear surfaces, for example.

The invention can be formed from a variety of semi-conductor materials, composites, and/or combinations thereof, including, without limitation, ceramic matrix composites, metal matrix composites, carbon-carbon composites, polymer matrix composites, and/or combinations thereof. The invention is compatible with silicon and other such materials regarding their coefficient of thermal expansion, stiffness and strength.

A heat exchanger in accordance with the present invention can be implemented to provide cooling capabilities to 500 watts/cm$^2$ ("W/cm$^2$"), in a laminar mode, and to 1000 W/cm$^2$ in a turbulent mode, without phase-change. The laminar flow mode provides relatively minimal or no flow induced jitter. Such heat exchangers are suitable for many applications, and are particularly suited for optical environments such as cooling SLMs.

FIG. 12 is a graph showing thermal performance of the present invention, which perform at levels comparable to boiling fluids, generating laminar heat transfer coefficients of the order of 50-100 W/m$^2$-K.

FIG. 13 is a graph showing how values are achieved by capitalizing on the engineering heat transfer "J-factor" within the laminar Reynold's number regime. An important factor is to structure the heat exchanger geometry in a manner that exhibits a relatively low length to hydraulic diameter ratio (L/D), such as near unity, for example. This is where the "j-factor" is near maximum to yield large values for the heat transfer coefficient which generates high absorbing heat loads.

Example Lithography Implementation

A heat exchanger in accordance with the present invention can be utilized to transfer heat from a variety of types of devices, including optical, electrical, and/or mechanical devices, and/or combinations thereof. For example, and without limitation, a heat exchanger in accordance with the present invention is implemented in a lithography system to cool an array of individually controllable elements, such as spatial light modulator ("SLM") chips.

FIG. 14 is a block diagram of an example lithographic apparatus 1400 in which the heat exchanger can be implemented. Apparatus 1400 includes a radiation system 1402, an array of individually controllable elements 1404 (e.g., an array of SLMs), an object table 1406 (e.g., a substrate table), and a projection system ("lens") 1408.

In operation, a source 1412 (e.g., an excimer laser) generates a beam of radiation 1422. The beam of radiation 1422 is provided to the radiation system 1402, which outputs a projection beam 1410 of radiation (e.g., UV radiation).

More particularly, the beam of radiation 1422 is directed to an illumination system (illuminator) 1424, either directly or after having traversed a conditioning device, such as a beam expander 1426, for example. The illuminator 1424 optionally includes an adjusting device 1428 that sets outer and/or inner radial extents of an intensity distribution in the beam 1422. The illuminator 1424 typically includes various other components, such as an integrator 1430 and a condenser 1432. The resultant projection beam 1410 has a desired uniformity and intensity distribution in its cross-section.

Beam 1410 subsequently intercepts the array of individually controllable elements 1404 (e.g., a programmable mirror array), after being directed by beam splitter 1418. The array of individually controllable elements 1404 applies a pattern to the projection beam 1410.

The position of the array of individually controllable elements 1404 is optionally fixed relative to projection system 1408. Alternatively, the array of individually controllable elements 1404 is connected to a positioning device (not shown) that positions the individually controllable elements 1404 with respect to projection system 1408. As here depicted, the individually controllable elements 1404 are of a reflective type (e.g., have a reflective array of individually controllable elements), such as a spatial light modulator.

The array of individually controllable elements 1404 directs the patterned beam 1410 through the beam splitter 1418 and to the projection system 1408. The projection system 1408 directs the patterned beam 1410 to the object table 1406.

The object table 1406 typically includes a substrate holder (not shown) that holds a substrate 1414, such as a resist-coated silicon wafer or glass substrate. The object table 1406 is optionally coupled to a positioning device 1416, which adjustably positions substrate 1414 relative to projection system 1408.

The projection system 1408 projects the patterned beam 1410 received from the beam splitter 1418 onto a target portion 1420 (e.g., one or more dies) of substrate 1414. The projection system 1408 optionally projects an image of the array of individually controllable elements 1404 onto substrate 1414. Alternatively, projection system 1408 projects images of secondary sources for which the elements of the array of individually controllable elements 1404 act as shutters.

Additional details of the array of individually controllable elements 1404 is now described. FIG. 15 is top plan view of an example array 1500 of spatial light modulators used to implement the array of individually controllable elements 1404. The array of individually controllable elements 1404 includes one or more of the arrays 1500. Spatial light modulators are described, for example, in U.S. Pat. No. 5,311,360, which is incorporated herein by reference in its entirety.

In the example of FIG. 15, the array 1500 includes an 8×8 array of mirrored elements 1504, which are individually controlled by drivers that are located in regions 1502. Other array sizes can also be utilized. For example, and without limitation, a 512×512 or a 1024×1024 array can be utilized. In an embodiment, each mirrored element 1504 of array 1500 includes a series of elongate displaceable members 1602 (FIG. 16). The displaceable members 1602 are controlled by, for example, sample and hold circuits 1702 (FIG. 17), located adjacent to the displaceable members 1602.

During operation, the beam 1410 (FIG. 14) directed at the array(s) 1500 generates heat within the array(s) 1500. Accordingly, a heat exchanger in accordance with the invention is placed in physical contact with the array(s) 1500. The heat exchanger can be mounted to a rear surface of the array 1500 that is opposite to a front surface on which the mirror elements 1504 are mounted. Alternatively, or additionally, the heat exchanger is mounted to one or more side surfaces of the array 1500. Where the individually controllable elements 1404 include multiple arrays 1500, one or more heat exchangers are mounted to one or more surfaces of the individually controllable elements 1404.

FIG. 18 is a block diagram of an SLM/heat-exchanger system 1800 which utilizes a first heat exchanger 1802 to cool an SLM 1804, and a second heat exchanger 1806 to cool circuitry associated with the SLM 1804. The heat exchangers 1802 and 1806 are implemented in accordance with the present. invention.

FIG. 19 is another block diagram of the SLM/heat-exchanger system 1800, including the SLM 1804 and the first and second heat exchangers 1802 and 1806.

Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. An apparatus comprising:

a heat exchanger with a heat exchanging core, fluid inlet, and fluid outlet; and a plurality of heat conducting plates positioned within a cavity of the heat exchanger between the fluid inlet and the fluid outlet, each of the plurality of heat conducting plates comprising a first set of channels formed along a first edge of the plate and a second set of channels formed along a second edge of the plate;

at least one end-plate to connect the plurality of heat conducting plates at a common end of the heat conducting plates.

2. The apparatus according to claim 1, wherein each of the first and second sets of channels has a length of less than 10 millimeters.

3. The apparatus according to claim 1, wherein each of the first and second sets of channels has an average channel length to hydraulic diameter ratio of approximate unity.

4. The apparatus according to claim 1, wherein each of the first and second sets of channels has an average channel length to hydraulic diameter ratio of approximately 2.

5. The apparatus according to claim 1, wherein the plurality of heat conducting plates and the at least one end-plate form an accordion footprint.

6. The apparatus according to claim 1, wherein the at least one end-plate has weep holes formed therethrough.

7. The apparatus according to claim 1, wherein the fluid inlet and fluid outlet each include a honeycomb insert.

8. The apparatus according to claim 1, wherein each of the plurality of heat conducting plates is fabricated from at least one of:

ceramic matrix composites;

metal matrix composites;

carbon-carbon composites; and polymer matrix composites.

9. The apparatus according to claim 1, wherein the plurality of heat conducting plates comprises at least 100 channels.

10. The apparatus according to claim 1, wherein the plurality of heat conducting plates comprises at least 1000 channels.

11. The apparatus according to claim 1, wherein the plurality of heat conducting plates comprises at least 4000 channels.

12. The apparatus according to claim 1, wherein the plurality of heat conducting plates comprises at least 5000 channels.

13. The apparatus according to claim 1, wherein a pressure drop between the fluid inlet and the fluid outlet during operation is less than 10 pounds per square inch.

14. The apparatus according to claim 1, wherein a pressure drop between the fluid inlet and the fluid outlet during operation is less than 1 pound per square inch.

15. The apparatus according to claim 1, wherein each of the first and second sets of channels comprises a portion of the respective channel that separates the first set of channels from the second set of channels.

16. The apparatus according to claim 1, wherein each of the plurality of heat conducting plates comprises at least one channel formed between a first side and a second side of each of the heat conducting plates, the at least one channel having a channel length to hydraulic diameter ratio less than 100.

17. The apparatus according to claim 1, wherein each of the channels in the first and second sets of channels has a channel length to hydraulic diameter ratio less than 100.

18. A method of transferring heat from an object, comprising:

positioning a heat exchanger body proximate to the object;

providing a coolant liquid into a cavity within the heat exchanger body;

passing the coolant liquid, from a fluid inlet of the cavity to a fluid outlet of the cavity, through a plurality of channels formed through a plurality of heat conducting plates within the cavity of the heat exchanger body, wherein each of the heat conducting plates in the plurality of heat conducting plates comprises a first set of channels formed along a first edge of the plate and a second set of channels formed along a second edge of the plate;

transferring heat from the plates to the coolant liquid as the coolant liquid passes through the channels;

refreshing the coolant liquid; and repeating the providing, passing, transferring, and refreshing steps.

19. The method according to claim 18, wherein the passing the coolant liquid includes passing the coolant liquid through the plurality of channels.

20. A method of making a heat exchanger, comprising:

providing a housing having a cavity therein, the housing including a fluid inlet and a fluid outlet coupled to the cavity;

providing a heat exchanging core having at least one heat conducting plate, wherein the at least one heat conducting plate comprises a first set of channels formed alone a first edge of the plate and a second set of channels formed along a second edge of the plate;

providing at least one end-plate to connect the at least one heat conducting plate to another heat conducting plate at a common end of the heat conducting plates; and positioning the heat exchanging core within the cavity between the fluid inlet and the fluid outlet;

wherein the channels are independent of the fluid inlet and the fluid outlet and provide a fluid path within the cavity for fluid running between the fluid inlet and the fluid outlet.

21. The method according to claim 20, wherein the providing the heat exchanging core includes providing the at least one heat conducting plate with the first and second sets of channels that have a length of less than 10 millimeters.

22. The method according to claim 20, wherein the average channel length to hydraulic diameter ratio of each of the channels in the first and second sets of channels is approximate unity.

23. The method according to claim 20, wherein the providing the heat exchanging core includes providing two or more heat conducting plates.

24. The method according to claim 20, wherein the providing the heat exchanging core includes forming an accordion footprint with the at least one and the another heat conducting plates.

25. The method according to claim 24, wherein the providing the heat exchanging core includes coupling together the at least one and the another heat conducting plates with end plates, the end plates having weep holes formed therethrough.

26. The method according to claim 20, wherein the providing the housing includes providing the fluid inlet and fluid outlet with a honeycomb insert.

27. The method according to claim 20, wherein the providing the housing includes providing a housing fabricated from at least one of:

ceramic matrix composites;

metal matrix composites;

carbon-carbon composites; and polymer matrix composites.

28. The method according to claim 20, wherein the providing the heat exchanging core includes providing a heat exchanging core fabricated from at least one of:

ceramic matrix composites;

metal matrix composites;

carbon-carbon composites; and polymer matrix composites.

29. The method according to claim 20, wherein the providing the heat exchanging core includes providing the at least one heat conducting plate with at least 100 channels.

30. The method according to claim 20, wherein the providing the heat exchanging core includes providing the at least one heat conducting plate with at least 5000 channels.

* * * * *

UNITED STATES PATENT AND TRADEMARK OFFICE

CERTIFICATE OF CORRECTION

PATENT NO. : 8,210,248 B2
APPLICATION NO. : 11/812634
DATED : July 3, 2012
INVENTOR(S) : Herman Vogel It is certified that error appears in the above-identified patent and that said Letters Patent is hereby corrected as shown below:

Title Page, Item (56) References Cited in "Other Publications" Section, after "11, 2007" please delete "English abstract of Japanese Patent Publication No. JP 6-5755, 1 page." and insert --English abstract of Japanese Patent Publication No. JP 6-5755, 1 page.-- below "11, 2007"

In column 11, claim 20, line 55, after "formed", please delete "alone" and insert --along--

Signed and Sealed this
Twenty-first Day of August, 2012

David J. Kappos

David J. Kappos
*Director of the United States Patent and Trademark Office*